United States Patent [19]

Corbett

[11] Patent Number: 4,687,103

[45] Date of Patent: Aug. 18, 1987

[54] JEWELRY DISPLAY DEVICE

[76] Inventor: Mary D. Corbett, 2009 Hamilton La., Carmel, Ind. 46032

[21] Appl. No.: 758,166

[22] Filed: Jul. 23, 1985

[51] Int. Cl.[4] ..... B65D 73/00

[52] U.S. Cl. ..... 206/566; 211/46; 211/13; 248/473; 206/489; 206/495

[58] Field of Search ..... 206/566, 495, 488, 486, 206/481, 489, 477; 38/102.2, 102.91; 211/13; 248/67.5, 473, 505

[56] References Cited

U.S. PATENT DOCUMENTS

| | | | |
|---|---|---|---|
| 1,414,351 | 5/1922 | Fritz | 248/473 |
| 1,527,356 | 2/1925 | Glauser et al. | 206/45.18 |
| 2,119,832 | 6/1938 | Schless | 206/562 |
| 2,684,820 | 7/1954 | Korn | 248/450 |
| 3,339,874 | 9/1967 | Kersters | 211/45 |
| 3,458,163 | 7/1969 | Smith | 248/67.5 |
| 3,678,607 | 7/1972 | Tabor et al. | 38/102.91 |
| 3,885,333 | 5/1975 | Zachary | 38/102.91 |
| 3,957,157 | 5/1976 | Therrien | 206/0.83 |
| 4,023,674 | 5/1977 | Manley | 206/562 |
| 4,043,449 | 8/1977 | Love | 206/45.14 |
| 4,181,224 | 1/1980 | Aber | 206/566 |
| 4,287,986 | 9/1981 | Beck | 206/45.19 |
| 4,311,235 | 1/1982 | Titus | 206/483 |
| 4,420,084 | 12/1983 | Whelan | 206/566 |
| 4,422,250 | 12/1983 | Golan | 38/102.2 |
| 4,465,179 | 8/1984 | Miller | 206/37 |
| 4,549,366 | 10/1985 | Gerding et al. | 38/102.2 |
| 4,606,458 | 8/1986 | LaBate | 206/566 |

FOREIGN PATENT DOCUMENTS

| | | | |
|---|---|---|---|
| 2540086 | 3/1976 | Fed. Rep. of Germany | 206/566 |
| 399361 | 10/1933 | United Kingdom | 206/566 |

*Primary Examiner*—William Price
*Assistant Examiner*—Brenda J. Ehrhardt
*Attorney, Agent, or Firm*—Jack C. Sloan

[57] ABSTRACT

A device for displaying or storing jewelry such as pierced earrings, medals, nametags and like items having a decorative front portion and a back portion having at least one pin-like shaft which cooperates with a clamp to hold such items in place on the user's clothing or body. The device provides a virtually infinite number of positions and relationships in which such items can be displayed. It consists of a cloth panel mounted to a first frame which is mounted to a second frame of equal or larger size. Optionally, either frame may be provided with means for holding the device in an upright position and/or suspending it from a vertical surface such as a wall.

3 Claims, 9 Drawing Figures

JEWELRY DISPLAY DEVICE

BACKGROUND OF THE INVENTION

1. Field of the Invention

This invention generally relates to devices for holding and displaying those articles of jewelry, decorations, nametags, medals and the like which have a front decorative or informative portion and at least one pin-like shaft such as those found on pierced earrings, and a clamping device for engaging the pin-like shaft and thereby holding the decorative item in position.

2. Description of the Prior Art

A number of devices have been designed to display jewelry items having pin-like shafts such as those used to mount pierced earrings and the like. By way of example, U.S. Pat. No. 4,181,224 teaches a framed display surface comprising at least two layers of sheet plastic material overlaying a base and at least two layers of filler material interposed between the two layers of sheet plastic material. The layers of sheet plastic material have a plurality of holes which require that each hole in the inner layer of the sheet material be located in direct axial alignment with a corresponding hole in the outer layer of the sheet plastic material. However, these rows and columns of holes have a certain unaesthetic quality to many users. Similarly, U.S. Pat. No. 4,420,084 teaches a book-like frame having a single rigid sheet of plastic or like material mounted in each side of the book-like frame. Here again the rigid display sheet has regular rows and columns of apertures for receiving the pin-like shafts of the jewelry items.

Such devices are adequate for storing or displaying jewelry items having a single pin-like shaft. They would also be adequate for storing articles such as nameplates having two or more pin-like shafts if, and only if, the spacing of the pin-like shafts on the back of the nameplate coincides with the spacing of the apertures in the rigid display sheets. Unfortunately, there are few established norms or conventions with respect to distances between the multiple pin-like shafts found on nameplates, medals, decorations and the like. Consequently, such items are not normally stored or displayed on such frames, but rather are stored in receptacles of one sort or another. Moreover, even if the distances between multiple pin-like shafts on such items were standardized, and even if the apertures in these prior art display sheets were standardized to the same dimensions, there still would remain a relatively limited number of positions in which nameplates and jewelry items could be displayed. This limitation follows from the fact that the prior art display surfaces are provided with a series of more or less regular rows and columns of equally spaced apertures. Hence the ability to change the display relationships of items for purposes of surfacespace utilization and/or for reasons of artistic inclinations of the user are limited by the matrix in which the pin-receiving apertures are manufactured.

SUMMARY OF THE INVENTION

Applicant has found a method for overcoming these limitations so that jewelry items such as pierced earrings, medals, decorations, nametags and like items having pin-like shaft portions can be conveniently stored and decoratively displayed in virtually an infinite number of different display configurations on the display panel of Applicant's jewelry display device. Such displays are more esthetically pleasing than rigid, defined rows and columns of holes. These results are achieved by a jewelry display device comprising a first frame having a cloth panel mounted thereto and a second frame of comparable or greater size than the first frame affixed to said first frame. The cloth panel may be mounted to the first frame by various means including, but not limited to, glue, staples, cord-and-groove, etc. In one preferred embodiment of this invention, the side of the first frame displaying the rough edges resulting from the mounting of the cloth panel is covered by a second frame of equal size such that the cloth is sandwiched between the two frames. The frames may be mounted in an abutting relationship to each other by various means such as gluing, screws, clamps, locks and the like.

In another preferred embodiment of this invention, a larger outer frame is provided with means for receiving a smaller inner frame such that the inner frame is held in place within the outer frame. Preferably the larger outer frame has a removable section so that the inner frame can be inserted into the outer frame. The expressions "larger" and "smaller" refer to the outer dimensions of each type of frame. The removable section can be completely detached from the remainder of the outer frame, or it can be hingedly attached to the remainder of the outer frame. The outer frame will also be provided with a groove or channel for receiving the inner frame and/or the inner frame and the thickness of the associated cloth which, in some methods of mounting, may surround the inner frame. This embodiment will further comprise a smaller inner frame to which the cloth panel is secured. The inner frame may also comprise specific means for attaching the inner frame to the outer frame. However, the most preferred method for attaching the inner frame to the outer frame is to provide one or more grooves or channels in the inside edges of the outer frame. The dimensions of the inner frame are then made such that the inner frame can be slid into the channels in the outer frame. A snug compression type fit, making allowance for cloth overlapping the edges of the inner frame, where this is a feature of the method by which the cloth is attached to the inner frame, is the preferred method of attachment.

As hereinafter more fully discussed, the inner frame may have fixed, permanent dimensions or it may be biased outward in order to abut snugly against the inside of the outer frame and/or against channels in the inside edge of the outer frame. This outward biasing can also be used as the means to secure the cloth in its panel-forming position with respect to the inner frame. That is to say the edges of a cloth panel can be compressed between the inside edges and/or channels of the outer frame and the outward biased inner frame. The outward bias of the inner frame is best achieved by constructing the inner frame in the form of a metal open loop such as the one taught in U.S. Pat. No. 4,422,250.

Preferably the cloth used to form the jewelry display panel is of a soft loose weave fabric such as, for example wool, rather than a hard, tight weave fabric such as silk. This preference follows from the fact that hard, tight weave fabrics are sometimes difficult to pierce and would tend to be permanently damaged by penetration of the pin-like shaft of the displayed earrings, medals, nameplates and the like. The outer and inner frames are preferably made of wood, plastic, metal or cermic materials.

In some preferred embodiments of this invention, the cloth panel is permanently attached to the inner frame by gluing, stapling and like techniques generally known to the picture framing art. The cloth panel may itself be decorative in nature and may include decorative regions such as those produced by embroidering, crocheting, silkscreening, painting, etc., in order to highlight or display a particular item in such regions. Again, the inner frame can be attached to the outer frame by a variety of procedures and devices such as, for example, fitting the inner frame into grooves in the outer frame or bolting or gluing it to the outer frame. For reasons of simplicity and versatility, however, the insertion of the inner frame into grooves in the inside of at least two inside surfaces of the outer frame in a compression fit is the preferred method of attaching the inner frame to the outer frame. The compression fit should be, however, loose enough to allow removal by normal pressures exerted by the human hand. This method also facilitates the ability to interchange various inner frames into the outer frame. That is to say, inner frames having cloth panels of different colors or design motifs may be interchanged with the user's desires. In the case of the rectangular frames used in this invention, the inner frame can be inserted completely into grooves or channels on the inside edges of the outer frame. The opening in the outer frame into which the inner frame is inserted into the grooves in the outer frame may be closed by various arrangements. For example, it may be closed by virtue of the fact that the inner frame may have one larger side which corresponds in length to the open side of the outer frame.

In another embodiment, the open side in the outer frame may be closed by replacing a portion, preferably a complete side, of the outer frame in the opening of the outer frame. Such a portion is most conveniently the lower portion which may also contain a groove for receiving the lower edge of the inner frame. In another alternative, the inner frame may be attached to the lower portion of the outer frame. This lower portion of the outer frame may conveniently be held in place by virtue of the fact that the inner frame is snugly inserted into a groove in the outer frame. Obviously, the lower part of the outer frame may contain various devices such as pins, locks, notches and the like to hold the inner frame to the lower part of the outer frame.

Optionally, the outer frame and/or the inner frame can also be provided with means for standing the outer frame in a vertical or semi-vertical position in order to display jewelry items and the like. For example, the lower portion of the outer frame may be enlarged so that it acts as a base upon which the apparatus stands. Such an arrangement has the added advantage of leaving the back side of the cloth panel freely accessible to the user's fingertips when attaching or detaching the clamps from the pin-like shafts. And in this regard, methods for standing these devices in an upright or nearly upright position which tend to maximize access to the rear of the cloth panels may also be achieved by wire frame stands or other open faced stands which are attached to the outer vertical sides of the outer frame. In a less preferred embodiment, solid, vertical upright stands of the type usually hingedly attached to the backs of picture frames might also be used. The outer frame might also be attached to a wall, door, or item of furniture by means of hooks or hinges. When hinge mounted in this manner, the device can be swung from a plane parallel to the wall, door or furniture item to a plane perpendicular or substantially perpendicular to the wall, door, etc. To this end, known hinges, particularly those which are biased toward and/or temporarily lock in certain positions e.g., 90 degrees, can be employed.

In another vein, the apparatus also may be provided with hooks in order to hang the device upon a wall in the manner in which a picture frame is hung. This method is, however, less preferred since the back side of the panel is not readily accessible.

In yet another embodiment of this invention, the inner frame is not a rigid member, but rather is an outwardly biased, open loop. Preferably such a loop terminates in finger grips which can be used to compress the loop inwardly in order to insert it into a channel in an outer frame having a shape similar to that of the loop as it seeks its outward biased position. Preferably, the finger grips also serve as a stand of a type hereinafter illustrated.

Suitable materials for the outer frame would be any material or materials having enough rigidity to permit the apparatus to stand and hold the cloth panel in a substantially upright position. As previously noted, suitable outer frame construction materials would include wood, plastic, ceramic and metal materials. However, for aesthetic reasons, ceramic materials and wooden frames resembling picture frames are preferred. Likewise the preferred material for the inner frame is also a rigid material such as wood, plastic, metal or ceramic materials. Wood, of course, is particularly preferred if the cloth panel is to be stapled to the inner frame. In the case where the inner frame is an outwardly biased loop a resilient material such as spring steel or plastic is highly preferred. Here again, suitable materials for the panel would include any cloth capable of being penetrated by the pin-like shaft of the article. These cloths may have less body or thickness than used in the rigid inner frame embodiments of this invention. In all cases, however, cloths having a loose weave and/or soft fibers are preferred; and cloths capable of receiving knitted or embroidered decorations are particularly preferred.

The apparatus thus disclosed emphasizes that the display panel is capable of displaying a wide variety of decorative items in an almost infinite number of positions on the panel and/or with respect to each other. Such frames are also easily transported and displayed. They permit the articles to be transported, such as in a suitcase, because the inner frame and its associated cloth panel are recessed within the outer frame. Hence, the decorative portions and clip portions of the article are each protected during travel. Those skilled in this art will also appreciate that all of the above frames can be provided in kit form and used for other related purposes such as the display of needlework.

BRIEF DESCRIPTION OF THE DRAWINGS

Illustrative embodiments of the invention are shown in the accompanying drawings wherein.

DESCRIPTION OF THE PREFERRED EMBODIMENT

The device of this invention is particularly adapted for displaying and/or storing those decorative items, such as name tags, decorations and jewelry items such as earrings for pierced ears, having pin-like shafts or posts attached to the rear side of a base and a decorative portion secured to the front of the base. Such pin-like shafts are then attached to clips, clamps, bolts and like holding means for securing the item to the clothing or body of the user. The shafts may vary. For example, earring posts are generally thin, needle like pins, but in the case of medals, decorations, nametags and the like, the pin-like shaft has to be strong enough to pierce a thick, tightly woven fabric.

Figure 1:
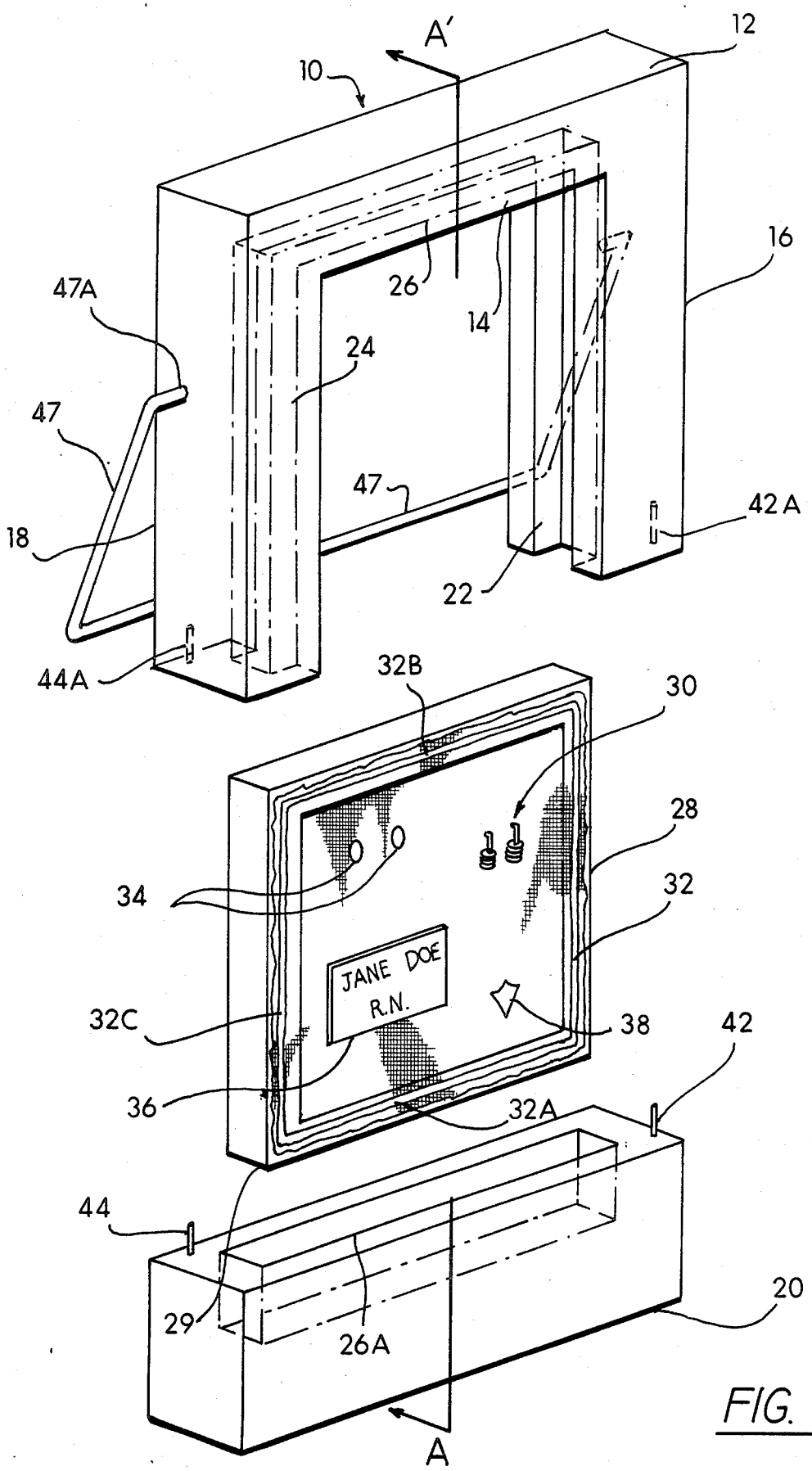
FIG. 1 is an exploded perspective view of a rectangular framed embodiment of my device for holding jewelry and the like for display and/or storage.

FIG. 1 is a perspective view of one embodiment of this invention in a rectangular picture frame-like configuration 10. It is comprised of an outer frame 12 having an upper frame portion 14, a right-side outer frame portion 16, a left-side outer frame portion 18 and a bottom frame portion 20. A channel 22 is provided in the right side frame portion 16 and a channel 24 is provided in the left side frame portion 18. Optionally, and preferably, the upper frame portion 14 is also provided with a channel 26 and the lower frame portion 20 is also provided with a channel 26A. The outer frame 12 depicted here is rectangular, but as will hereinafter be shown, the frame may be of any suitable shape such as a square, circle or oval.

This embodiment further comprises an inner frame 28 having a cloth panel 30 fixed to the inner frame by various means of attachment such as gluing, stapling, tacking, or by a cord and groove system such as 32, 32A, 32B and 32C depicted in FIG. 1. As in the case of the apparatus shown in FIG. 6, the cloth may be held by compression fitting it into grooves in the outer frame by use of an outwardly biased inner frame which compresses the cloth between a channel of the outer frame and the outwardly biased inner frame. In any case, the cloth panel of FIG. 1 is shown with various items displayed thereon, e.g., earrings 34, a nameplate 36, and a decorative pin 38. This display is intended to emphasize the fact that the cloth display panel 30 enables the user to place such items in virtually any location upon the cloth panel 30 and in virtually any relationship to each other within the confines of said panel. The lower frame 20 is shown provided with a channel 26A for receiving the lower portion 29 of the inner frame 28. Again, a compression fitting of the inner frame 28 into the channel 26A is a preferred means of attachment since this would aid in holding the lower portion of the frame 20 to the left 18 and right 16 sides of the frame 12. Additional means for holding the lower portion of the frame 20 to the sides of the frame such as, for example, pins 42 and 44 used in conjunction with the holes 42A and 44A in the right 16 and left 18 sides of the outer frame can also be employed. The outer frame 12 is shown provided with a wire frame support stand 47 supported at pivot points 47A on the outer frames 12.

Figure 2:
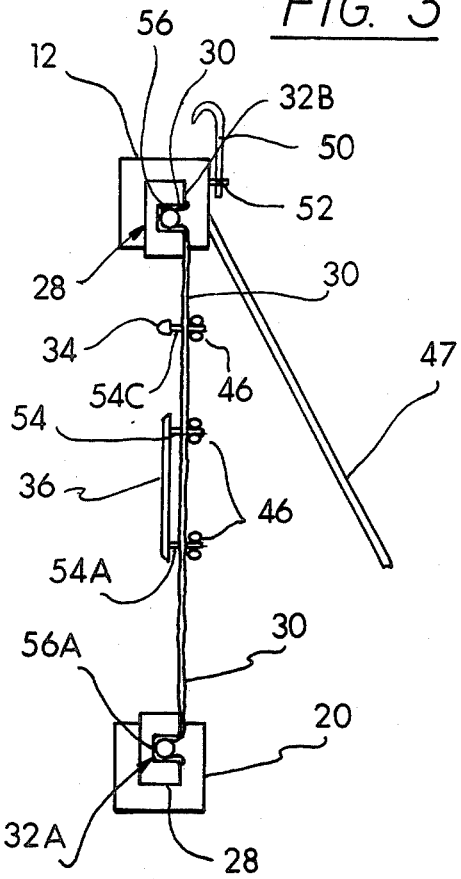
FIG. 2 is a cross-section view of the device as seen along plane A—A' of FIG. 1.
Figure 9:
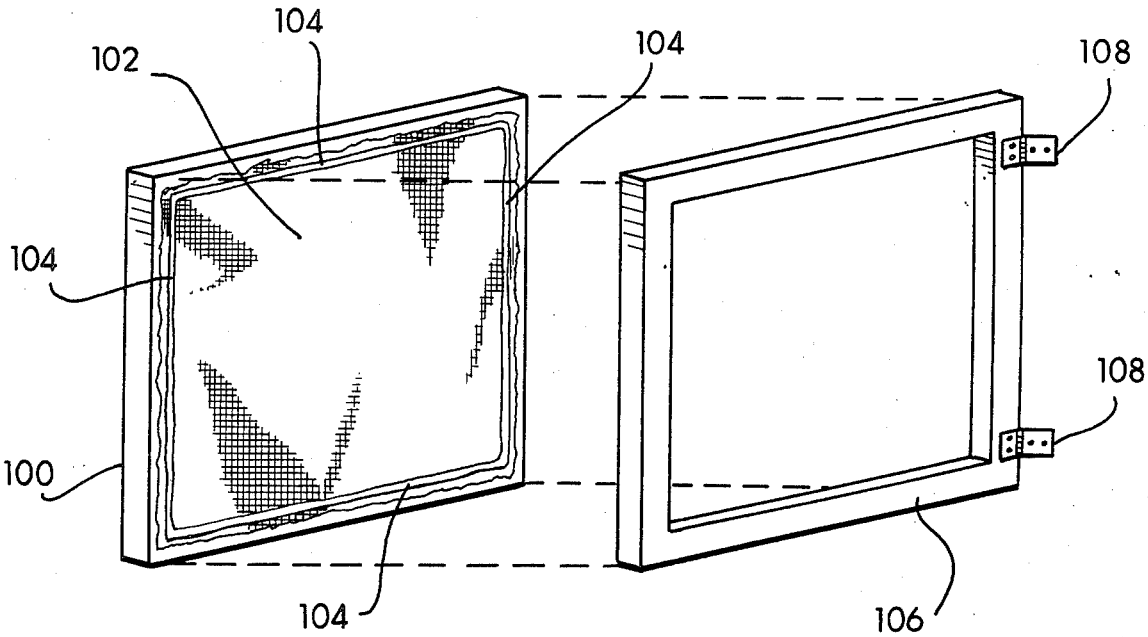
FIG. 9 is an exploded perspective view of a frame of the type shown in FIG. 8, but shown provided with hinges rather than a stand.

FIG. 2 is a cross section taken in plane A—A' of FIG. 1. It shows a display article such as a name plate 36 having an upper pin-like shaft 54 and a lower pin-like shaft 54A penetrating the cloth panel 30. Holding means such as clamps or clips 46 are shown attached to the pins 54 and 54A. Likewise, an earring 34, having a pin 54C, is shown penetrating in the cloth panel 30 and terminating in a similar clip 46. The upper portion of inner frame 28 is shown with a groove 56 into which the cloth is placed and held in place by a cord 32B jammed into the groove 56 in the manner of so-called cord and groove work. Similarly a cord 32A holds the cloth 30 in a groove 56A in the lower portion of the inner frame 28. Optionally, the frame can be provided with a stand, preferably a wire stand 47 for holding the frame in an upright or semi-upright position. Preferably the stand 47 is mounted to the outer frame in a pivot relationship achieved by pivot 47A. The outer frame may also be optionally provided with hanging means such as the hook 50 shown attached to the upper frame 12 by means of a pivot 52 such that the hook 50 can be turned down out of sight when the hook 50 is not being used to hang the outer frame to a hook or nail on a wall or other vertical surface. However, such a hook 50 is not a preferred way to hang this device on the wall since both sides of the panel need to be accessible in order to attach the items to be displayed. Therefore, hinges on a side of the device as illustrated in FIG. 9 is a more preferred method for hanging this device from a vertical plane such as a wall since in such a hinged arrangement, the frame could swing away from the wall in the manner of an opening door to expose the rear side of the cloth panel 30.

Figure 3:
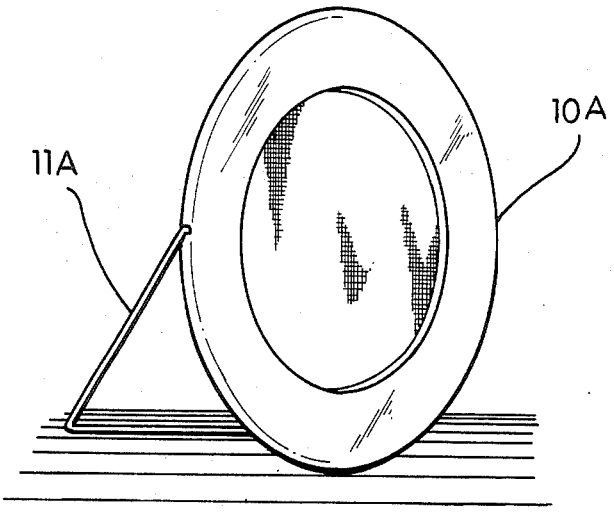
FIG. 3 is a perspective view of an oval shaped embodiment of this invention.

FIG. 3 shows an oval-shaped frame 10A supported by a wire frame support means 11A.

Figure 4:
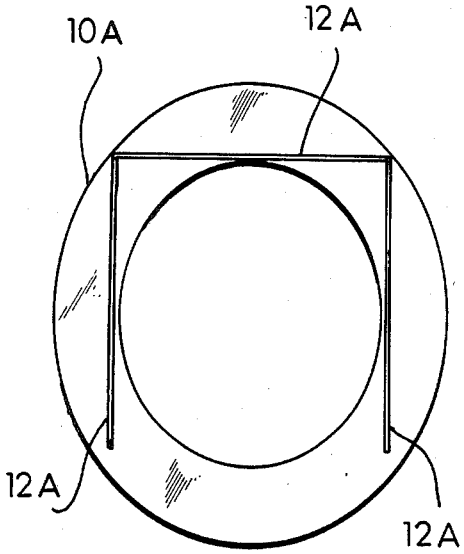
FIG. 4 is a rear view of the oval shaped frame showing rectangular grooves for receiving a rectangular inner frame.
Figure 8:
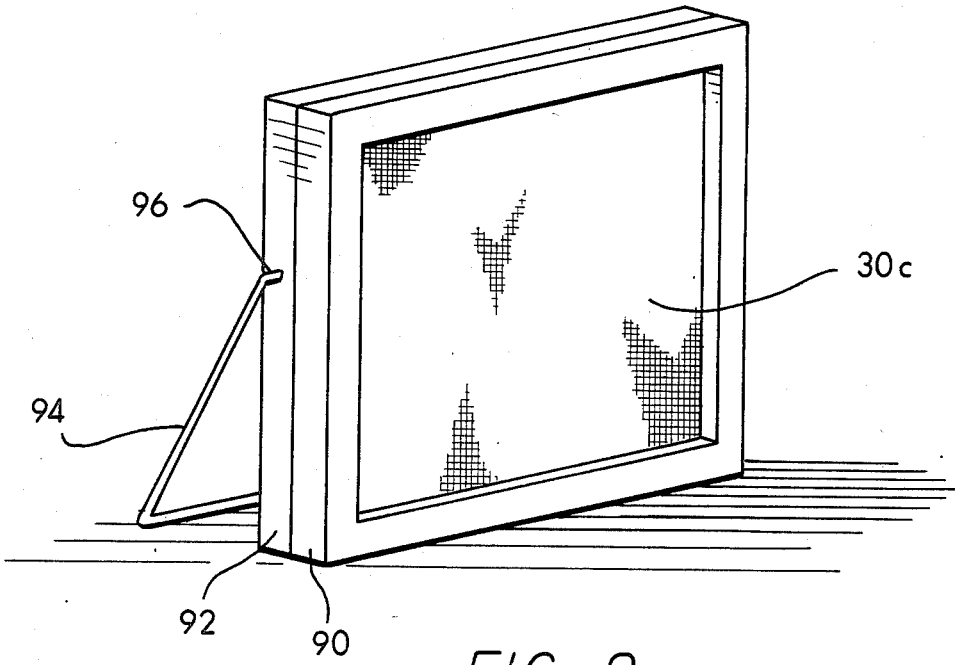
FIG. 8 is a perspective view of an embodiment of this invention wherein the cloth panel is sandwiched between two square frames of equal size supported by a wire stand.

FIG. 4 shows a rear view of the frame 10A of FIG. 8. Holding means such as grooves 12A are shown for receiving an inner panel not shown.

Figure 5:
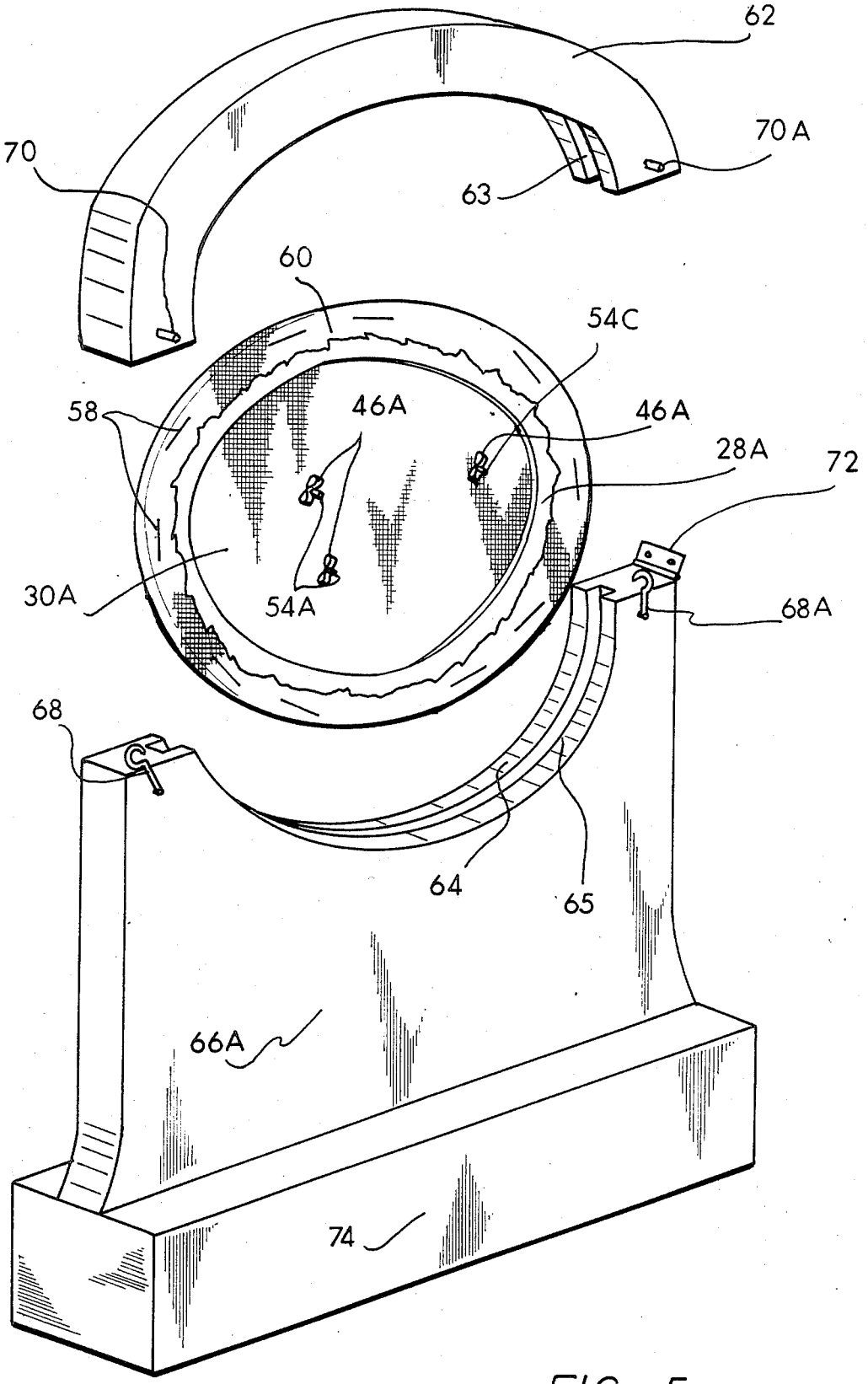
FIG. 5 is an exploded perspective view of an oval framed embodiment of the device.

FIG. 5 shows an oval-shaped inner frame 28A to which a cloth panel 30A has been attached by means of staples 58 driven through the cloth into the frame 28A. The cloth 30A encompasses the edges of the inner frame 28A and the jagged edges of the cloth 60 are shown on what would be the back side of the frame 28A. Likewise the back side of the cloth panel 30A is shown penetrated by shaft pins 54A and 54C. Each is shown provided with a clip, nut, clamp or like holding means 46A to engage the pin-like shaft and hold the item in place on the front of the cloth panel 30A. The upper frame 62 is oval shaped as is the inner frame receiving portion 64 of the lower frame 66A. The upper frame 62 is shown with means, such as grooves or channels 63, for securing the inner frame 28A within the upper frame 62. The lower frame 66A has a counterpart channel 65. The lower frame 66A is shown provided with pivotal hooks 68 and 68A for engaging pins 70 and 70A respectively in the upper frame portion 62. Another possible means for holding the upper frame 62 to the lower frame 62 would be the attachment of a hinge 72 to one side of the upper frame and lower frame so tha the upper frame 62 and the lower frame 66A are in a hinged relationship. The lower frame 66A is also shown provided with an enlarged base portion 74 for standing the apparatus in a substantially vertical position for displaying the items on the cloth panels and for maximum access to the rear of the cloth panel as well as to its front.

Figure 6:
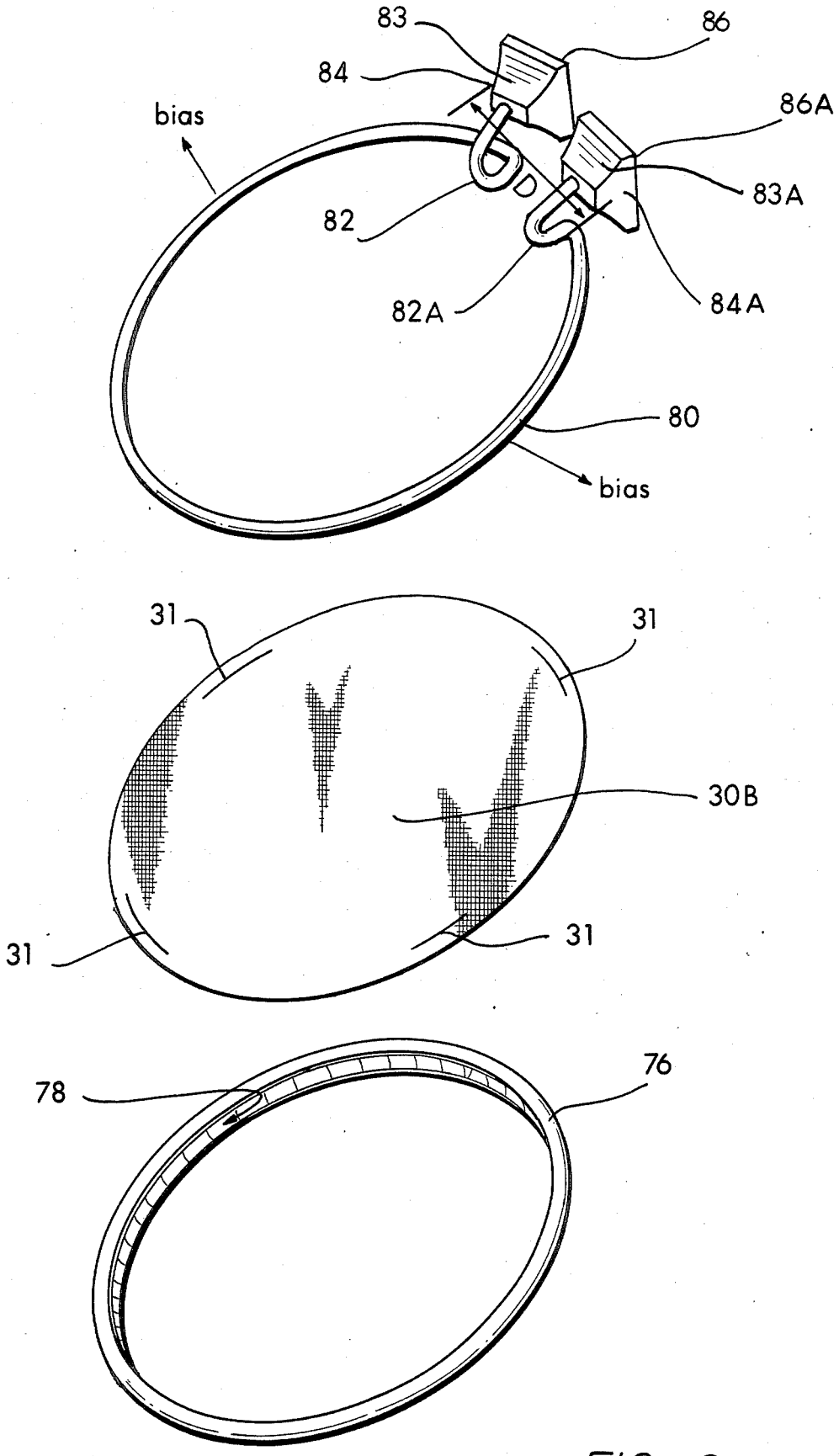
FIG. 6 is an exploded perspective view of an embodiment of this invention having an outwardly biased inner frame.

FIG. 6 shows an exploded, perspective view of another embodiment of this invention wherein the inner frame is comprised of an outwardly biased open loop 80 ending in curved regions 82 and 82A which extend out of the plane defined by the major portion of the open loop. Curved region 82 terminates in a foot-like stand 83 having an upright region 84 and a base region 86. Likewise, curved region 82A terminates in a foot-like stand 83A having an upright region 84A attached to base region 86A. Preferably the distance D between the outside surfaces of upright regions 84 and 84A can be spanned by the human thumb and finger in order to compress the open loop 80 for insertion into an outer frame 76 having a channel 78 for receiving the loop 80. The edges 31 of a cloth 30B are held in the channel 78 of the outer frame 76 by the outward bias of the loop 80 and thereby forming a cloth panel upon which items having pin-like shafts may be displayed.

Figure 7:
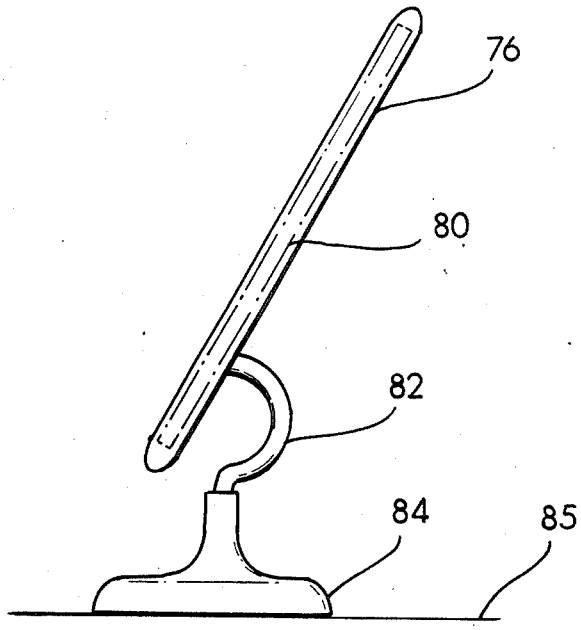
FIG. 7 is a end view of the device shown in FIG. 6 shown assembled and setting upon bases which also serve as finger grips by which the loop is compressed for insertion into the outer frame.

FIG. 7 shows the device of FIG. 6 assembled and standing on surface 85 such as a dressing table.

FIG. 8 shows an embodiment of this invention wherein a cloth panel 30C is shown sandwiched between a first frame 90 and a second frame 92 of equal size. The frames 90 and 92 are held in an abutting relationship to each other by holding means such as glue or bolts not shown in this view. The device is shown supported by a wire stand 94 attached in a hole 96 into which a perpendicularly bent, end portion (not shown) of the wire stand 94 is inserted.

FIG. 9 shows an exploed perspective view of a frame system such as that shown in FIG. 8. Frame 100 is shown provided with a cloth panel 102 mounted by cords 104 forced into grooves not shown. Frame 106 is shown provided with hinges 108 for attaching the device to a body having a vertical plane such as a wall, door, item of furniture and the like.

It will be appreciated that the above described preferred embodiments of this invention can be modified without departing from the scope and spirit of this invention.

Thus, having disclosed my invention, I claim:

1. A device for displaying jewelry and the like having a decorative front face and a back portion having at least one pin-like shaft which attaches to a clamping means, the device comprising:

an outer frame having a central opening and a narrow channel extending inwardly from and surrounding a substantial portion of the periphery of said opening;

an inner frame shaped and sized to be received in said channel;

a panel of woven material adapted to be penetrated by the pin-like shaft and having means attaching said panel to said inner frame;

said outer frame including means for holding said inner frame in the channel of said outer frame; and means for holding the device in a substantially upright position.

2. The device of claim 1 wherein the inner and outer frames have a rectangular shape.

3. The device of claim 1 wherein the inner and outer frames have a curved shape.

* * * * *